US005189821A

United States Patent [19]

Lee

[11] Patent Number: 5,189,821

[45] Date of Patent: Mar. 2, 1993

[54] LIQUID WAVE DISPLAY ORNAMENT

[76] Inventor: Vincent K. W. Lee, No. 44, Lane 458, Sheh Chung Street, Taipei, Taiwan

[21] Appl. No.: 790,454

[22] Filed: Nov. 12, 1991

[51] Int. Cl.[5] ..... G09F 19/02

[52] U.S. Cl. ..... 40/406; 40/426; 446/134; 446/136

[58] Field of Search ..... 40/406, 412, 426, 439; 446/134, 136, 267, 358, 481

[56] References Cited

U.S. PATENT DOCUMENTS 813,082 2/1906 Cottrell ..... 446/134
3,425,157 2/1969 Hartsock ..... 446/134
3,466,795 9/1969 Friedman ..... 446/358
4,176,469 12/1979 Timco ..... 40/406 X
4,467,553 8/1984 Kanda ..... 446/481 X

*Primary Examiner*—James R. Brittain
*Assistant Examiner*—J. Bonifanti
*Attorney, Agent, or Firm*—Bacon & Thomas

[57] ABSTRACT

Waves are imparted to liquids of different specific gravities having an ornament floating therein by a movable diaphragm provided with a magnet alternatively exposed to additional magnets of different polarities to alternatively attract and repulse the magnet, thereby causing the diaphragm to create waves in the liquids.

5 Claims, 7 Drawing Sheets

LIQUID WAVE DISPLAY ORNAMENT

BACKGROUND OF THE INVENTION

The present invention relates to liquid display ornaments and, more particularly, to a liquid display ornament which has means to continuously stir up a liquid into waves.

Several liquid display ornaments have been known. For example, FIG. 1 illustrates a pinwheel type liquid-filter ornament and FIG. 2 illustrates a floating ornament. The pinwheels in the liquid-filter ornament of FIG. 1 will be caused to rotate only when the liquid-filter ornament is turned upside-down. Once the liquid in one water chamber has been completely discharged into the other water chamber, the liquid-filter ornament stops operating. The floating ornament of FIG. 2 will produce waves to float a miniature sail only when it is shaken. Once the shaking force is stopped, the liquid in the floating ornament will soon calm down. In FIG. 3 there is illustrated another type of liquid display ornament which comprises a water container above a base. The water container is filled with a liquid. Inside the water container, there is a block having two magnets at two opposite sides with the polarity thereof opposed to each other. The base has a variable coil fastened therein. When power is turned on, the block is caused by the variable coil to turn about, and therefore, the fish-like float is simultaneously moved in the liquid just like a fish looking for food. The present invention provides a new structure for a liquid display device.

SUMMARY OF THE INVENTION

It is the main object of the present invention to provide a liquid wave display ornament which utilizes magnetic attraction and repulsion to move a movable diaphragm so as to stir up liquids into waves. It is another object of the present invention to provide a liquid wave display ornament in which the movable diaphragm can be caused to alternatively move up and down or oscillate back and forth so as to produce different waves. It is still another object of the present invention to provide a liquid wave display ornament in which the movable diaphragm is attached with ornamental devices and carried to move in liquids.

According to an embodiment of the present invention, a liquid wave display ornament is generally comprised of a transparent water container fastened above a base and filled with two liquids of different specific gravity. The water container has a movable diaphragm mounted on a guide rod, which movable diaphragm has at least one magnet fastened on the bottom edge thereof. The base has a variable magnetic device fastened therein and disposed below the at least one magnet on the movable diaphragm. When the variable magnetic device is turned on, the polarity of the magnetic field is alternatively changed, and therefore, the at least one magnet on the movable diaphragm is alternatively attracted and repulsed by the variable magnetic device. By means of magnetic attraction and repulsion, the movable diaphragm is caused to alternatively move up and down or oscillate back and forth, and therefore, the liquids in the water container are stirred up into waves. Ornamental devices may be floating in the liquids or carried to move by the movable diaphragm.

DETAILED DESCRIPTION OF THE PREFERRED EMBODIMENTS

Figure 1:
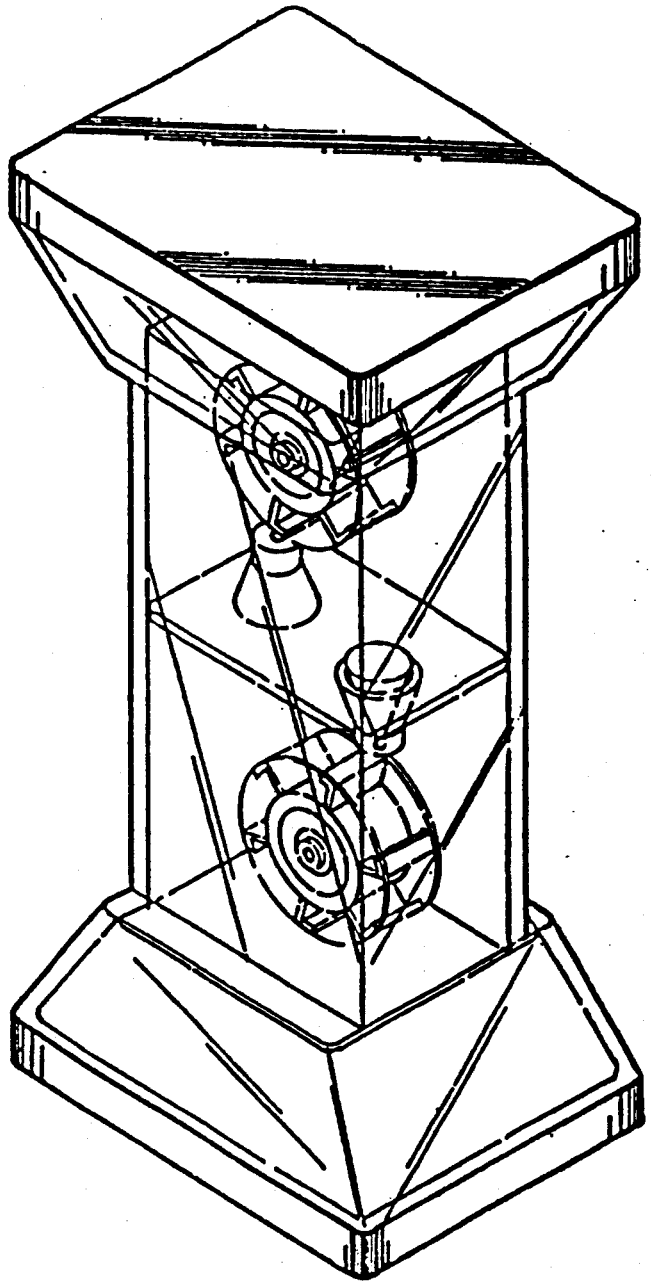
FIG. 1 PRIOR ART
FIG. 1 is a perspective view of a prior art pinwheel type of liquid-filter ornament.
Figure 2:
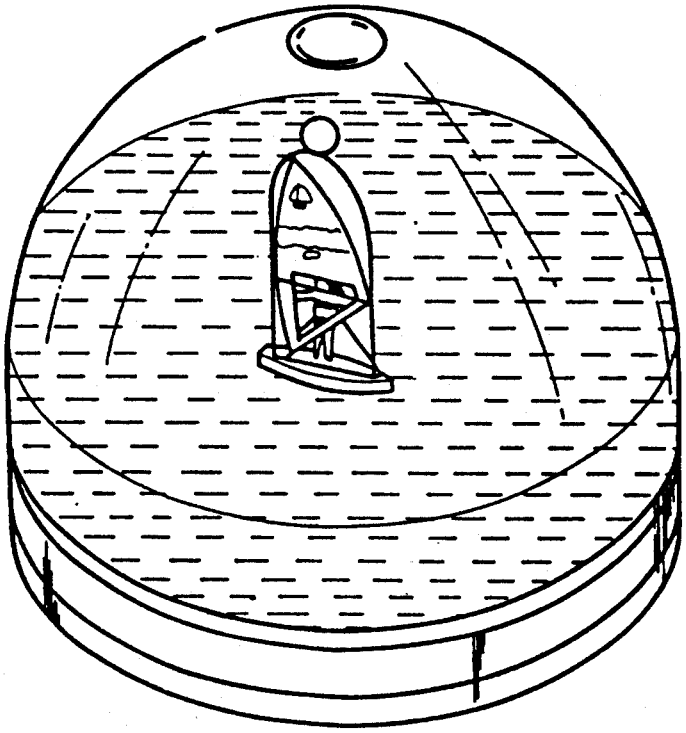
FIG. 2 PRIOR ART
FIG. 2 is a perspective view of a prior art floating ornament.
Figure 3:
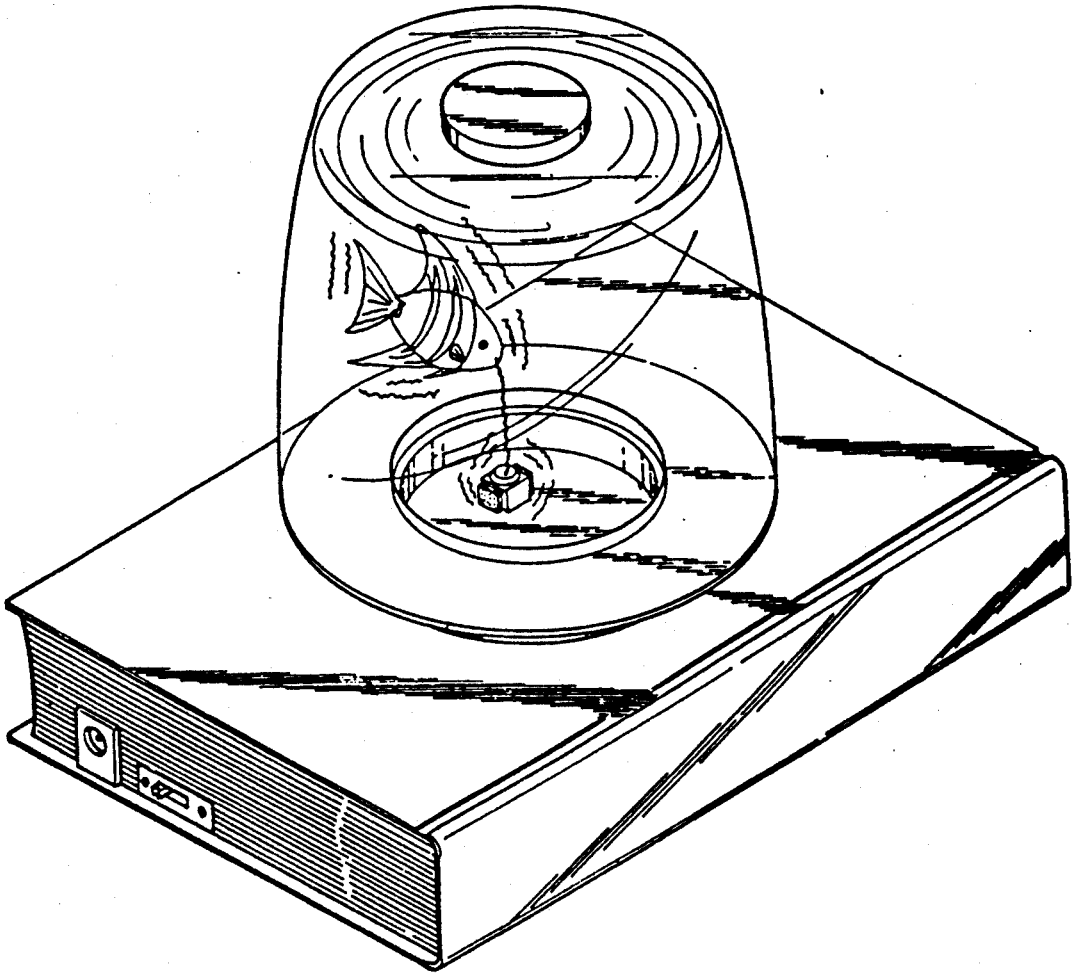
FIG. 3 (PRIOR ART)
FIG. 3 is a perspective view of another conventional structure of a liquid display ornament.
Figure 4:
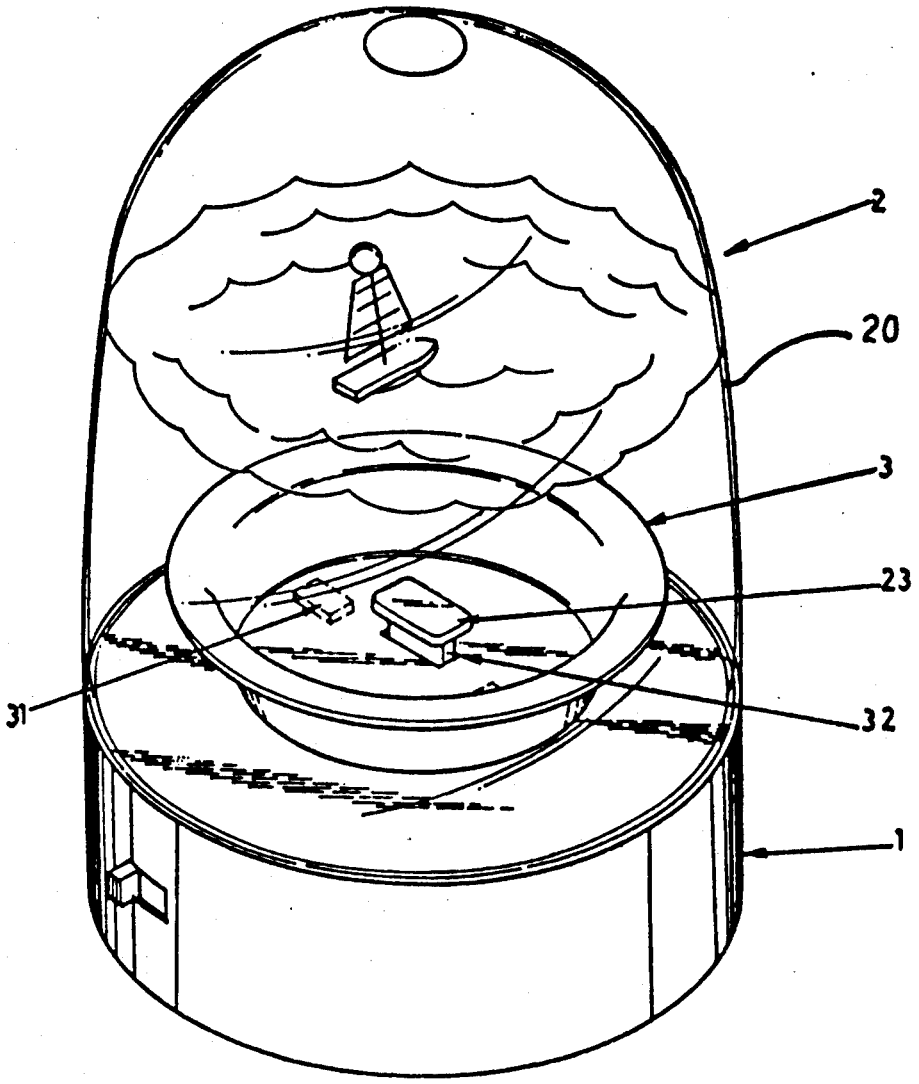
FIG. 4 is a perspective view of a liquid wave display ornament embodying the present invention.
Figure 5:
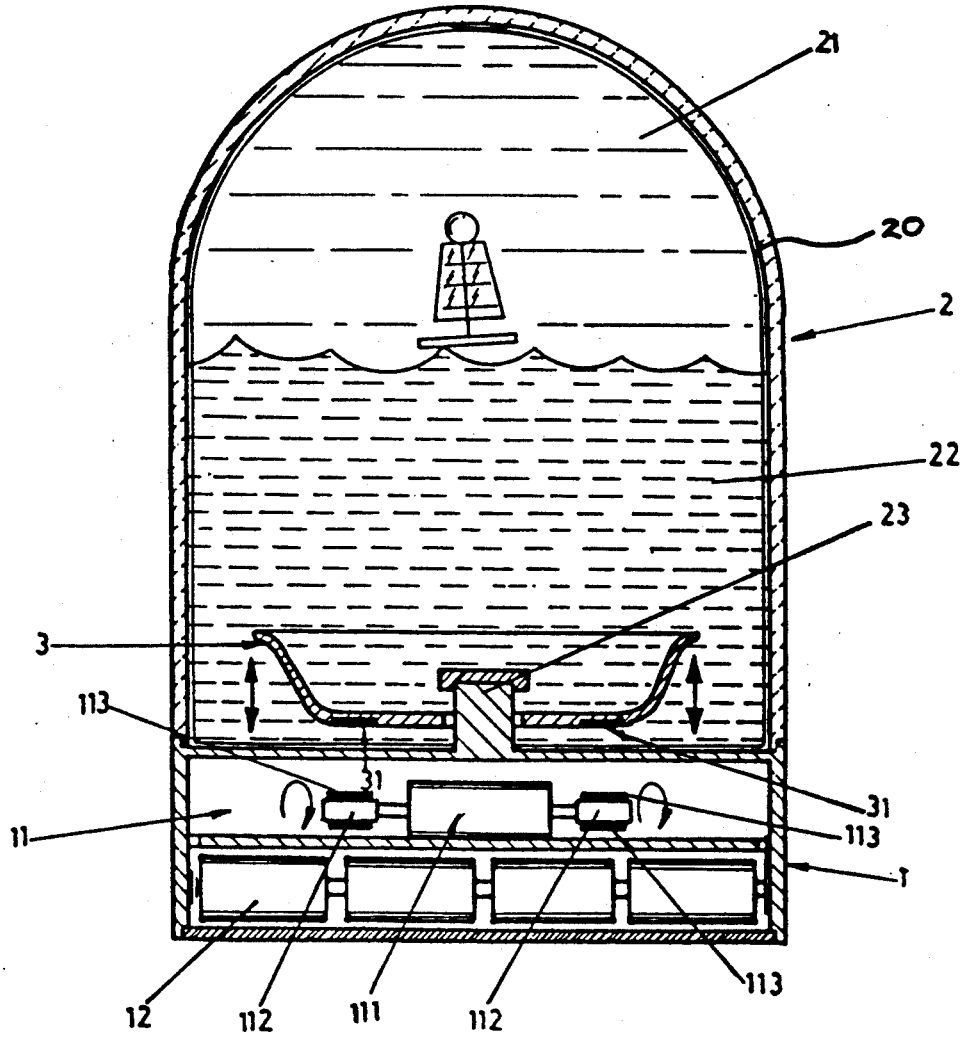
FIG. 5 is a sectional view of the liquid wave display ornament of FIG. 4 taken in longitudinal direction.

Referring to FIGS. 4 and 5, therein illustrated is a first embodiment of a liquid wave display ornament according to the present invention, which is generally comprised of a base 1 and a transparent cover 2. The base 1 defines therein an upper chamber 11 at the top and a battery chamber 12 at the bottom. Inside the upper chamber 11 of the base 1, there is provided a variable magnetic assembly which changes magnetic pole regularly. An inductance type magnetic core circuit may be used to produce a variable magnetic field. In the present embodiment, as shown in FIG. 5, a magnetic assembly is comprised of two rotary members 112 supported for rotation on the output shafts of a motor 111. Each rotary member 112 has two magnets 113 attached thereto at two opposite locations with the polarity thereof disposed against each other. Therefore, when the motor 111 starts, the magnetic pole (relative to the top edge of the base 1) is changed each every half run. The motor 111 may be directly connected to the battery set fastened in the battery chamber or to an external power supply. The revolving speed of the motor 111 may be set according to requirement. Further, the top edge of the base 1 must be made of such a material which permits magnetic force to pass therethrough. The transparent cover 2 is covered on the base 1 at the top with the gap therebetween sealed. The holding space inside the cover 2 above the base 1 is provided with a liquid container 20 which is divided into a water zone 22 at the bottom and an oil zone 21 at the top. The water in the water zone 22 and the oil in the oil zone 21 may be respectively colored. An ornamental float may be floating on the water in the water zone 22. Inside the water zone 22, there is a guide rod 23 vertically fastened in the top edge of the base 1 through container 20 to hold a movable diaphragm 3. The movable diaphragm 3 has magnets 31 on the bottom edge thereof which, when the motor 111 is rotated, will be alternatively attracted or repulsed by the magnets 113 on the rotary members 112. In order to let the movable diaphragm 3 move up and down on the guide rod 23 and to prohibit it from rotary motion, the hole on the movable diaphragm 3 and the cross section of the guide rod 23 shall not be made in a round shape. Further, the movable diaphragm 3 may be transparent or made in a color similar to the color of the water in the water zone 22. The shape of the movable diaphragm 3 may be variously embodied. In the embodiment of FIG. 5, the movable diaphragm 3 is made in a horn-like shape. The magnets 31 on the movable diaphragm 3 may be fastened at symmetrical locations so that the movable diaphragm 3 can be caused to move up and down vertically, or at asymmetrical locations so that the movable diaphragm 3 can be caused to oscillate.

Figure 6:
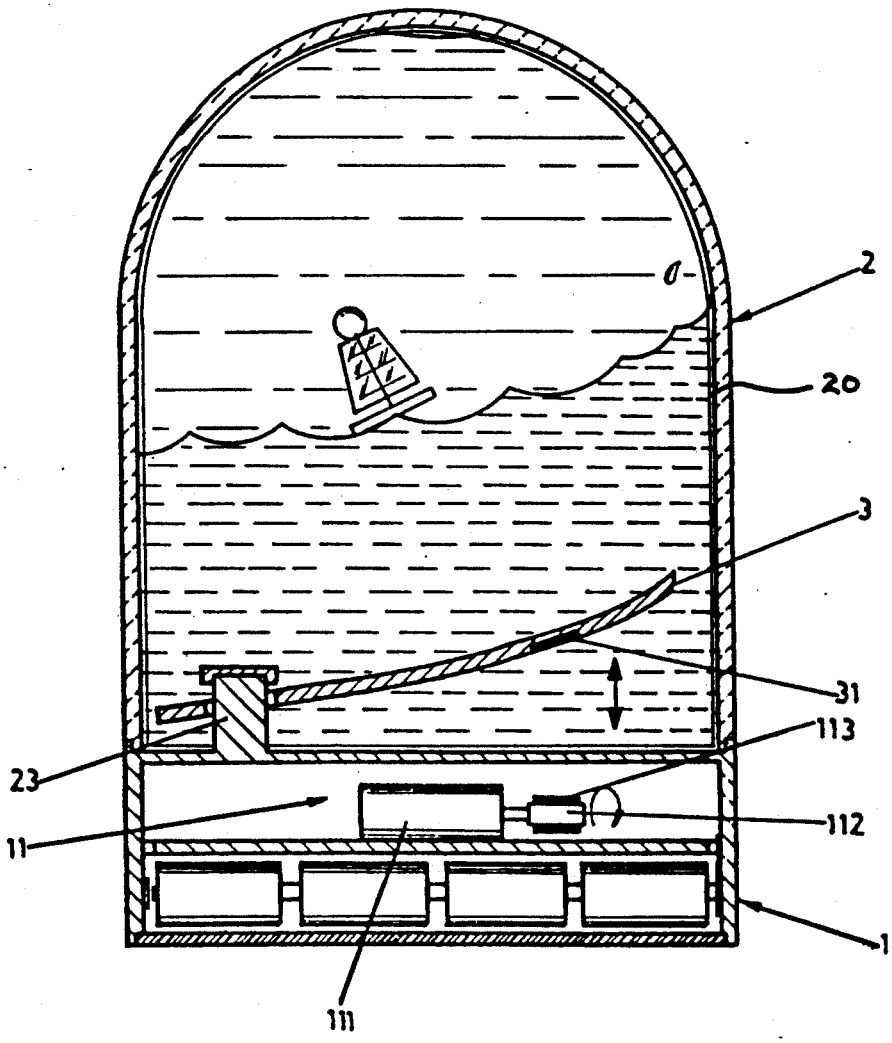
FIG. 6 is a sectional view of an alternate form of the present invention.

FIG. 6 illustrates an alternate form of the present invention, in which there is only one rotary member 112 carried to rotate by a motor 11, which rotary member 112 has two opposite magnets 113 attached thereto at two opposite locations. In this embodiment, the diaphragm 3 has one end fastened in the guide rod 23 and an opposite end suspended in the water. The suspended end of the diaphragm 3 has a magnet 31 fastened on the bottom edge thereof and disposed above the rotary member 112. When the motor 111 is turned on, the suspended diaphragm 3 will be caused to rock.

Figure 7:
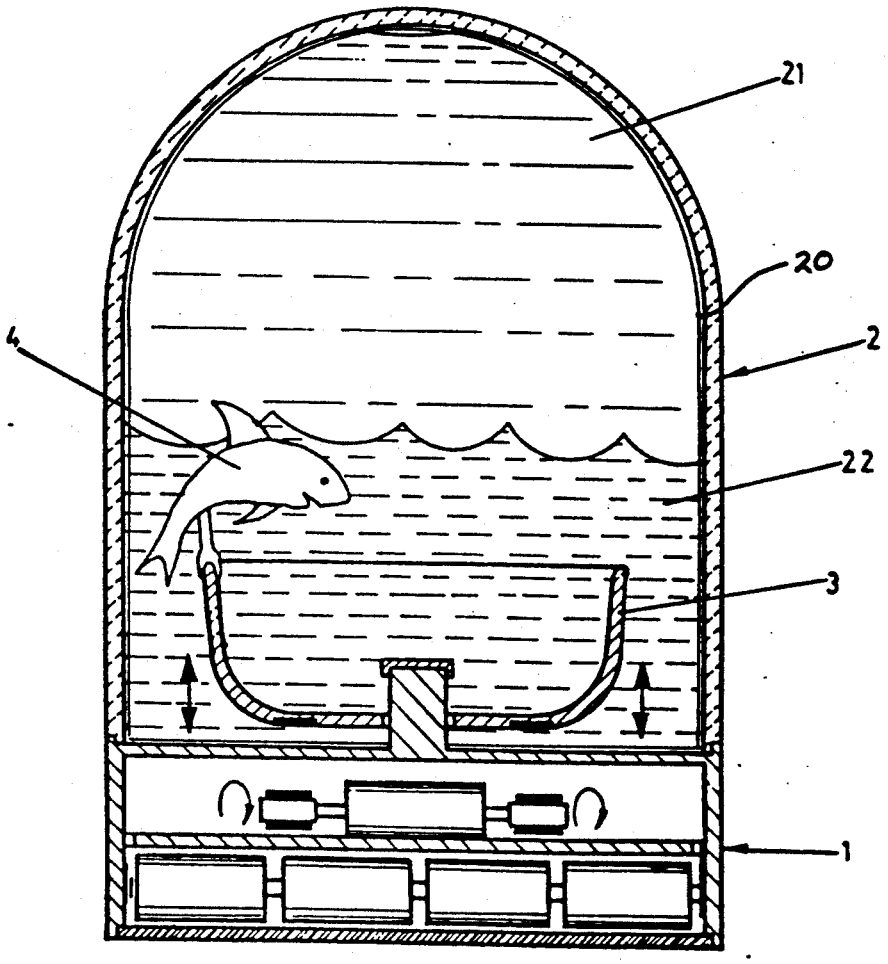
FIG. 7 is a sectional view of another alternate form of the present invention.

FIG. 7 illustrates another alternate form of the present invention. In this embodiment, the internal structure is similar to the first embodiment of FIG. 5 with the exception of the ornamental float. As illustrated, a shark-like ornamental device 4 is fastened to the diaphragm 3 at its top. When the diaphragm 3 is caused to alternatively move either up and down or oscillate back and forth, the shark-like ornamental device 4 is caused to move in the water.

What is claimed is:

1. A liquid wave display ornament comprising:

a) a base;

b) a transparent liquid container supported on the base and filled with two liquids of different specific gravities;

c) a guide rod extending from the bottom of the liquid container;

d) a diaphragm supported for movement on the guide rod and including at least one magnet secured to a bottom portion thereof; and e) a variable magnetic device supported by the base and positioned below the magnet of the diaphragm, which magnetic device includes means for alternatively exposing magnetic forces of opposite polarities to the magnet for alternatively repulsing and attracting the magnet, thereby imparting a corresponding movement to the diaphragm for creating waves in the liquids.

2. The display ornament of claim 1 wherein the variable magnetic device includes:

a) an electric motor having at least one rotary output shaft; and b) a pair of magnets having different polarities mounted on opposite sides of the shaft.

3. The display ornament of claim 2 wherein the motor includes a pair of output shafts, and each output shaft includes a pair of magnets having different polarities mounted on opposite sides thereof.

4. The display ornament of claim 2 wherein:

a) the base includes an upper chamber and a lower chamber;

b) the motor and magnets of different polarities being disposed in the upper chamber; and c) a battery power supply for the motor disposed in the lower chamber.

5. The display ornament of claim 1 further including an ornamental device secured to the diaphragm.

* * * * *